US006251840B1

(12) United States Patent
Ward, Jr. et al.

(10) Patent No.: US 6,251,840 B1
(45) Date of Patent: Jun. 26, 2001

(54) LUBRICATION FLUIDS FOR REDUCED AIR ENTRAINMENT AND IMPROVED GEAR PROTECTION

(75) Inventors: William C. Ward, Jr.; Craig D. Tipton, both of Perry; Kathleen A. Murray, Euclid, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 08/783,530

(22) Filed: Jan. 14, 1997

Related U.S. Application Data

(63) Continuation of application No. 08/604,068, filed on Feb. 20, 1996, now abandoned, which is a continuation-in-part of application No. 08/527,124, filed on Sep. 12, 1995, now abandoned.

(51) Int. Cl.[7] ..... C10M 125/24; C10M 133/38

(52) U.S. Cl. ..... 508/162; 508/185; 508/189; 508/198; 508/273; 252/75

(58) Field of Search ..... 508/273, 185, 508/189, 198, 162, 164; 252/75

(56) References Cited

U.S. PATENT DOCUMENTS

| | | | | |
|---|---|---|---|---|
| 2,767,111 | * | 10/1956 | Otto et al. | 508/164 |
| 2,967,151 | * | 1/1961 | Morway | 508/164 |
| 3,502,677 | | 3/1970 | Le Suer | 260/268 |
| 3,933,659 | | 1/1976 | Lyle et al. | 252/32.7 |
| 4,136,043 | | 1/1979 | Davis | 252/47.5 |
| 4,140,643 | | 2/1979 | Davis | 252/47.5 |
| 4,178,260 | * | 12/1979 | Cook et al. | 508/164 |
| 4,188,299 | * | 2/1980 | Caspari | 252/46.7 |
| 4,193,882 | * | 3/1980 | Gemmill, Jr. | 252/47.5 |
| 4,295,983 | * | 10/1981 | Papay et al. | 252/49.6 |
| 4,301,019 | | 11/1981 | Horodysky et al. | 252/49.6 |
| 4,537,677 | | 8/1985 | Keil | 208/370 |
| 4,584,115 | * | 4/1986 | Davis | 252/49.6 |
| 4,612,127 | * | 9/1986 | Uematsuea | 508/164 |
| 4,612,129 | | 9/1986 | Di Biase et al. | 252/33.6 |
| 4,792,410 | * | 12/1988 | Schwind et al. | 525/38 |
| 4,801,390 | * | 1/1989 | Robson | 252/25 |
| 4,857,214 | | 8/1989 | Papay et al. | 252/32.5 |
| 4,990,273 | | 2/1991 | Croudace | 252/46.4 |
| 5,089,156 | | 2/1992 | Chrisope et al. | 252/49.9 |
| 5,354,484 | * | 10/1994 | Schwind et al. . | |
| 5,422,023 | | 6/1995 | Francisco | 252/47 |

FOREIGN PATENT DOCUMENTS

| | | | |
|---|---|---|---|
| 601266A | 5/1993 | (EP) | 285/125 |
| 630960A | 6/1994 | (EP) . | |
| 0 622 444 | 11/1994 | (EP) . | |
| 0 713 908 | 5/1996 | (EP) . | |
| 2 257 158 | 1/1993 | (GB) . | |
| 2 267 098 | 11/1993 | (GB) . | |
| 4 34892 | 1/1992 | (JP) . | |

* cited by examiner

*Primary Examiner*—Margaret Medley
(74) *Attorney, Agent, or Firm*—David M. Shold; Michael F. Esposito

(57) ABSTRACT

A lubricating/functional fluid composition which exhibits in use improved antiwear and antifoaming properties. The improvements result from use of 2,5-dimercapto-1,3,4-thiadiazole and derivatives thereof together with silicone and/or fluorosilicone antifoam agents.

19 Claims, No Drawings

LUBRICATION FLUIDS FOR REDUCED AIR ENTRAINMENT AND IMPROVED GEAR PROTECTION

This application is a continuation of Ser. No. 08/604,068 filed on Feb. 20, 1996 which is now abandoned and which is a continuation in part of Ser. No. 08/527,124 filed on Sep. 12, 1995 which is now abandoned.

BACKGROUND OF THE INVENTION

1. Field of the Invention

This invention encompasses lubricating compositions for use in automatic transmission fluids, tractor hydraulic fluids, manual transmission fluids, continuously variable transmission fluids, wet brake and wet clutch fluids, hydraulic fluids and the like. The fluids encompass both lubricating and functional properties. The compositions embody sulfur and boron-containing components as well as antifoam agents in an oil of lubricating viscosity. The compositions reduce wear in the device in which they are used. Decreased air entrainment in the fluid results in reduced fluid compressibility which results in improved operational parameters of devices containing the fluids.

2. Related Art

Functional/lubricating fluids are well known. As manufacturers of devices containing these fluids change equipment designs and operational specifications for these devices, such as automatic transmissions, new lubricating formulations must be developed. Such new formulations result in lubricating compositions with improved operational standards.

U.S. Pat. No. 5,422,023 describes lubricant compositions alkyl substituted dimercaptothiodiazoles together with an alpha-olefin/malic ester copolymer in a lubricating oil.

U.S. Pat. No. 4,990,273 describes an antiwear additive for lubricating compositions which is the reaction product of 2,5-dimercapto-1,3,4-thiadiazole with an aldehyde and an amine.

U.S. Pat. No. 4,612,129 describes dimercapto-thiadiazole derivatives as corrosion inhibitors used in compositions containing a metal salt of a dithiocarbamic acid of formula $R_1(R_2)N$—CSSH and an oil soluble sulfurized organic compound.

U.S. Pat. No. 4,301,019 describes reacting mercapto-thiadiazole with hydroxyl-containing unsaturated esters, or their borated derivatives to yield products useful as friction reducing additives in lubricants.

U.S. Pat. No. 4,140,643 describes reacting an oil-soluble dispersant with a dimercapto-thiadiazole and subsequently reacting the intermediate thus formed with a carboxylic acid or anhydride. The compositions are useful dispersants, extreme pressure agents and inhibitors of copper activity.

U.S. Pat. No. 4,136,043 describes reacting an oil soluble dispersant and a dimercapto-thiadiazole at 100–250° C. until the reaction product will form a homogeneous blend with a lubricating oil.

European Patent Application publication number 0630 960 A1 discloses the use of dimercapto-thiadiazoles with a copolymer of methacrylate, methyl-methacrylate and an amine-based antioxidant.

European Patent Application publication number 0601266 A1 describes novel compounds prepared by reacting 2,5-dimercapto-1,3,4-thiadiazole, aldehydes, and aromatic amines and their use as antiwear and antioxidant agents in lubricating compositions.

SUMMARY OF THE INVENTION

This invention comprises a lubricating/functional fluid composition with improved antiwear, antifoaming and low temperature viscosity properties. The composition comprises A. An oil of lubricating viscosity having a 100° C. kinematic viscosity of 2–10 cSt;

B. sufficient weight percent of 2,5-dimercapto-1,3,4-thiadiazole (DMTD) and/or derivatives thereof to provide the composition with acceptable antiwear properties; and C. an antifoam agent.

The composition has a −40° C. Brookfield viscosity of less than 20,000 cP as determined by ASTM-D-2983. The composition, when evaluated according to ASTM tests for scuffing and air entrainment, demonstrates superior performance.

The composition, as well as containing sulfur contributed by the thiadiazoles, may contain boron as contributed by borated dispersants or other borated materials such as borated epoxides or mixtures thereof The composition may further contain phosphorus which may be contributed by phosphorus acid esters such as dibutyl hydrogen phosphite, diphenyl hydrogen phosphite, triphenyl phosphite and/or triphenyl thiophosphate.

DESCRIPTION OF PREFERRED EMBODIMENT

The lubricant and functional fluid compositions of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids.

The lubricants and functional fluid compositions of this invention employ an oil of lubricating viscosity which is generally present in a major amount (i.e. an amount greater than about 50% by weight). Generally, the oil of lubricating viscosity is present in an amount of greater than about 80% by weight of the composition.

The natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinicnaphthenic types which may be further refined by hydrocracking and hydrofinishing processes and are dewaxed. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl) silicate, hexyl-(4-methyl-2-pentoxy) disiloxane, poly(methyl) siloxanes, poly-(methylphenyl) siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from 1-decene. These PAOs may have a viscosity from about 2 to about 150.

Preferred base oils include poly- -olefins such as oligomers of 1-decene. These synthetic base oils are hydrogenated resulting in an oil of stability against oxidation. The synthetic oils may encompass a single viscosity range or a mixture of high viscosity and low viscosity range oils so long as the mixture results in a 100° C. kinematic viscosity of about 2–8 or 10 cSt. A −40° C. Brookfield viscosity of less than 20,000 cP as determined by ASTM-D-2983 must also be attained in the final functional fluid composition. Also included as preferred base oils are highly hydrocracked and dewaxed oils having a 100° C. kinematic viscosity of about 2–8 or 10 cSt. These petroleum oils are generally refined to give enhanced low temperature viscosity and antioxidation performance. A single oil of about 3.5–6 cSt viscosity at 100° C. may be employed or, mixtures of lower and higher viscosity oils may be employed to give a mixture having a viscosity of about 3.5–6 cSt viscosity at 100° C. Mixtures of synthetic oils with refined mineral oils may also be employed. Again, a −40° C. Brookfield viscosity value of less than 20,000 cP to less than 5,000 cP as determined by ASTM D-2983 must be attained on the final functional fluid composition.

Included in the oil of lubricating viscosity in the present invention is 0.025–5 weight percent on an oil-free basis based on the weight of the lubricating composition of 2,5-dimercapto-1,3,4-thiadiazole (DMTD) or derivatives thereof. Derivatives of DMTD are:

a) 2-hydrocarbyldithio-5-mercapto-1,3,4-thiadiazole or 2,5-bis-(hydrocarbyldithio)-1,3,4-thiadiazole and mixtures thereof;

b) carboxylic esters of DMTD;

c) condensation products of oc-halogenated aliphatic monocarboxylic acids with DMTD;

d) reaction products of unsaturated cyclic hydrocarbons and unsaturated ketones with DMTD;

e) reaction products of an aldehyde and diaryl amine with DMTD, f) amine salts of DMTD;

g) Dithiocarbamate derivatives of DMTD;

h) reaction products of an aldehyde, and an alcohol or aromatic hydroxy compound, and DMTD;

i) reaction products of an aldehyde, a mercaptan and DMTD;

j) 2-hydrocarbylthio-5-mercapto-1,3,4-thiadiazole;

k) products from combining an oil soluble dispersant with DMTD; and mixtures thereof Compositions a)–k) are described in U.S. Pat. No. 4,612,129 and patent references cited therein. These referenced are included herein by reference.

The preferred thiadiazoles for use in this invention are those listed in a), h), and k) above. 2,5-bis- (hydrocarbyldithio)-1,3,4-thiadiazole and its monosubstituted equivalent 2-hydrocarbylthio-5-mercapto-1,3,4-thiadiazole are commercially available as a mixture of the two compounds in a ratio of about 85 percent bis-hydrocarbyl to 15 percent monohydrocarbyl from the Ethyl Corporation as Hitec 4313.

U.S. Pat. Nos. 2,719,125; 2,719,126; and 3,087,937 describe the preparation of various 2,5-bis(hydrocarbyl dithio)-1,3,4-thiadiazoles. The hydrocarbon group may be aliphatic or aromatic, including cyclic, alicyclic, aralkyl, aryl and alkaryl. Such compositions are effective corrosion-inhibitors for silver, copper, silver alloys and similar metals. Such polysulfides which can be represented by the following general formula:

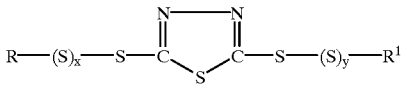

wherein R and $R^1$ may be the same or different hydrocarbon groups, and x and y be integers from 0 to about 8, and the sum of x and y being at least 1. A process for preparing such derivatives is described in U.S. Pat. No. 2,191,125 as comprising the reaction of DMTD with a suitable sulfenyl chloride or by reacting the dimercapto diathiazole with chlorine and reacting the resulting disulfenyl chloride with a primary or tertiary mercaptan. Suitable sulfenyl chlorides useful in the first procedure can be obtained by chlorinating a mercaptan (RSH or $R^1SH$) with chlorine in carbon tetrachloride. In a second procedure, DMTD is chlorinated to form the desired bissulfenyl chloride which is then reacted with at least one mercaptan (RSH and/or $R^1SH$). The disclosures of U.S. Pat. Nos. 2,719,125; 2,719,126; and 3,087,937 are hereby incorporated by reference for their description of derivatives of DMTD useful in the compositions of the invention.

U.S. Pat. No. 3,087,932 describes a one-step process for preparing 2,5-bis(hydrocarbyldithio)-1,3,4-thiadiazole. The procedure involves the reaction of either DMTD or its alkali metal or ammonium salt and a mercaptan in the presence of hydrogen peroxide and a solvent. Oil-soluble or oil-dispersible reaction products of DMTD can be prepared also by the reaction of the DMTD with a mercaptan and formic acid. Compositions prepared in this manner are described in U.S. Pat. No. 2,749,311. Any mercaptan can be employed in the reaction although aliphatic and aromatic mono- or polymercaptan containing from 1 to 30 carbon atoms are preferred. The disclosures of U.S. Pat. Nos. 3,087,932 and 2,749,311 are hereby incorporated by reference for their description of DMTD derivatives which can be utilized as components of the composition of this invention. It will be understood by those skilled in the art that the reactions outlined above produce some amounts of the monohydrocarbyldithio-thiadiazole as well as the bishydrocarbyl compounds. The ratio of the two can be adjusted by varying the amounts of the reactants.

The preparation of 2-hydrocarbyldithio-5-mercapto-1,3,4-thiadiazoles having the formula

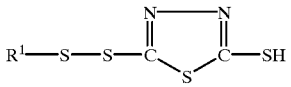

where $R^1$ is a hydrocarbyl substituent is described in U.S. Pat. No. 3,663,561. The compositions are prepared by the oxidative coupling of equimolecular portions of a hydrocarbyl mercaptan and DMTD or its alkali metal mercaptide. The compositions are reported to be excellent sulfur scavengers and are useful in preventing copper corrosion by active sulfur. The mono-mercaptans used in the preparation of the compounds are represented by the formula $R^1SH$ wherein $R^1$ is a hydrocarbyl group containing from 1 to about 28 carbon atoms. A peroxy compound, hypohalide or air, or mixtures thereof can be utilized to promote the oxidative coupling. Specific examples of the mono-mercaptan include methyl mercaptan, isopropyl mercaptan, hexyl mercaptan, decyl mercaptan, and long chain alkyl mercaptans, for example, mercaptans derived from propene polymers and isobutylene polymers especially polyisobutylenes, having 3 to about 70 propene or isobutylene units per molecule. The disclosure of U.S. Pat. No. 3,663,561 is hereby incorporated by reference for its identification of DMTD derivatives which are useful as components in the compositions of this invention.

U.S. Pat. No. 2,850,453 describes products which are obtained by reacting DMTD an aldehyde and an alcohol or an aromatic hydroxy compound in a molar ratio of from 1:2:1 to 1:6:5. The aldehyde employed can be an aliphatic aldehyde containing from 1 to 20 carbon atoms or an aromatic or heterocyclic aldehyde containing from about 5 to about 30 carbon atoms. Examples of suitable aldehydes include formaldehyde, acetaldehyde, benzaldehyde. The reaction can be conducted in the presence or absence of suitable solvents by (a) mixing all of the reactants together and heating, (b) by first reacting an aldehyde with the alcohol or the aromatic hydroxy compound, and then reacting the resultant intermediate with the thiadiazole, or (c) by reacting the aldehyde with thiadiazole first and the resulting intermediate with the hydroxy compound. The disclosure of U.S. Pat. No. 2,850,453 is hereby incorporated by reference for its identification of thiadiazole derivatives useful as components in the compositions of the present invention. The preferred products produced by the procedure above for use in this invention result from reacting DMTD, formaldehyde and heptyl phenol. The exact alkyl portion of this phenol is not critical and many are listed in U.S. Pat. No. 2,850,453 referenced above.

Another material useful as components in the compositions of the present invention is obtained by mixing a thiadiazole, preferably DMTD with an oil-soluble carboxylic dispersant in a diluent by heating the mixture above about 100° C. This procedure, and the derivatives produced thereby are described in U.S. Pat. No. 4,136,043, the disclosure of which is hereby incorporated by reference. The oil-soluble dispersants which are utilized in the reaction with the thiadiazoles are often identified as "ashless dispersants". Various types of suitable ashless dispersants useful in the reaction are described in the '043 patent.

The preferred products for the thiadiazole-dispersant material for inclusion in the compositions of this invention are DMTD with a nitrogen-containing polyester dispersant. The dispersant is formed by reacting a polyisobutenyl succinic anhydride, pentaerythritol and polyethyleneamines in the ratio of 1C═O:1.8OH:0.26N. The dispersant is then reacted with DMTD. The polyisobutylene portion of the dispersant has number average molecular weight of about 1000.

The amount DMTD and derivatives listed above add sulfur in the amount of 0.0075–0.5 weight percent to the composition of this invention.

In addition to the DMTD and DMTD derivatives described above, tolyltriazole may also be included in fully formulated fluids of this invention at a level of 0.005–0.5 weight percent. The tolyltriazole is used as a corrosion inhibitor in the fluids of this invention and is available commercially from PCM Specialties Group of Rocky River, Ohio.

As well as sulfur as described above which is included in the compositions of this invention as DMTD and derivatives and mixtures thereof, the compositions also contain boron in the amount of 0.002–0.2 weight percent. The boron is added to the composition as a borated epoxide or a borated dispersant. Other borated friction modifiers may be included in the composition. The borated compounds comprise 0.1–10 weight percent of the compositions of this invention. The preferred borated epoxides are borated fatty epoxides.

The borated epoxides are described in detail in U.S. Pat. No. 4,584,115 which is incorporated herein by reference. The epoxides used to react with boric acid or boron trioxide may be commercial mixtures of $C_{14-16}$ or $C_{14-18}$ epoxides. The mixtures may be purchased from ELF-ATOCHEM or Union Carbide. The borated compounds are prepared by blending the boron and epoxide compounds and heating them to about 80°–250° C. An inert liquid may be used in performing the reaction. The liquid may be toluene, xylene, chlorobenzene, dimethylformamide and the like. Water is formed and distilled off during the reaction. Alkaline reagents may be used to catalyze the reaction. Purified epoxy compounds such as 1,2 epoxyhexadecane may be purchased from Aldrich Chemicals.

Dibutyl hydrogen phosphite (DBPH) is another important component of the compositions of this invention and may be purchased from Mobil Chemicals, and Albright and Wilson. The DBPH is added to the composition at 0.05–2 weight percent on an oil-free basis. The same weight percent of diphenyl hydrogen phosphite or mixtures of the two phosphites may be included in the finished formulation.

Another important ingredient of the invention is an antifoaming agent. Antifoaming agents are well-known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylate antifoamer available from Monsanto Polymer Products Co. of Nitro, W. Va. known as PC-1244. Also, a siloxane polyether copolymer antifoamer available from OSI Specialties, Inc. of Farmington Hills, Mich. and may also be included. One such material is sold as SILWET-L-7220. The antifoam products are included in the compositions of this invention at a level of 5 to 80 parts per million with the active ingredient being on an oil-free basis.

A fully-formulated composition for use as contemplated by this invention may contain, in addition to the components listed above:

1. borated and/or non-borated dispersants;
2. anti-oxidation compounds;
3. seal swell compositions;
4. friction modifiers;
5. extreme pressure/anti-wear agents;
6. viscosity modifiers;
7. pour point depressants;
8. detergents.

1. Ashless Dispersants.

Non-borated ashless dispersants may be incorporated within the final fluid composition in an amount comprising up to 10 weight percent on an oil-free basis. Many types of ashless dispersants listed below are known in the art. Borated ashless dispersants may also be included.

(1) "Carboxylic dispersants" are reaction products of carboxylic acylating agents (acids, anhydrides, esters, etc.) containing at least about 34 and preferably at least about 54 carbon atoms are reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide, and ester reaction products of carboxylic acylating agents. Examples of these materials include succinimide dispersants and carboxylic ester dispersants.

The carboxylic acylating agents include alkyl succinic acids and anhydrides wherein the alkyl group is a polybutyl moiety, fatty acids, isoaliphatic acids (e.g. 8-methyl-octadecanoic acid), dimer acids, addition dicarboxylic acids (addition (4+2 and 2+2) products of an unsaturated fatty acid with an unsaturated carboxylic reagent), trimer acids, addition tricarboxylic acids (Empol® 1040, Hystrene® 5460 and Unidyme® 60), and hydrocarbyl substituted carboxylic acylating agents (from olefins and/or polyalkenes). In one embodiment, the carboxylic acylating agent is a fatty acid. Fatty acids generally contain from about 8 up to about 30, or from about 12 up to about 24 carbon atoms. Carboxylic acylating agents are taught in U.S. Pat. Nos. 2,444,328, 3,219,666 and 4,234,435, the disclosures of which are hereby incorporated by reference.

The amine may be a mono- or polyamine. The monoamines generally have at least one hydrocarbyl group containing 1 to about 24 carbon atoms, with from 1 to about 12 carbon atoms. Examples of monoamines include fatty (C8–30) amines, primary ether amines (SURFAM® amines), tertiary-aliphatic primary amines ("Primenes"), hydroxyamines (primary, secondary or tertiary alkanol amines), ether N-(hydroxyhydrocarbyl)amines, and hydroxyhydrocarbyl amines (Ethomeens" and "Propomeens"). The polyamines include alkoxylated diamines (Ethoduomeens), fatty diamines ("Duomeens"), alkylenepolyamines (ethylenepolyamines), hydroxy-containing polyamines, polyoxyalkylene polyamines (Jeffamines), condensed polyamines (a condensation reaction between at least one hydroxy compound with at least one polyamine reactant containing at least one primary or secondary amino group), and heterocyclic polyamines. Useful amines include those disclosed in U.S. Pat. No. 4,234,435 (Meinhart) and U.S. Pat. No. 5,230,714 (Steckel) which are incorporated herein by reference.

Examples of these "carboxylic dispersants" are described in British Patent 1,306,529 and in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and U.S Pat. No. Re 26,433 which are incorporated herein by reference for disclosure of dispersants.

(2) "Amine dispersants" are reaction products of relatively high molecular weight aliphatic or alicyclic halides and amines, preferably polyalkylene polyamines. Examples thereof are described for Example, in the following U.S. Patents: U.S. Pat. Nos. 3,275,554, 3,438,757, 3,454,555, and 3,565,804 which are incorporated herein by reference for disclosure of dispersants.

(3) "Mannich dispersants" are the reaction products of alkyl phenols in which the alkyl group contains at least about 30 carbon atoms with aldehydes (especially formaldehyde) and amines (especially polyalkylene polyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569 which are incorporated herein by reference for disclosure of dispersants.

(4) Post-treated dispersants are obtained by reacting at carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422 which are incorporated herein by reference for disclosure of dispersants.

(5) Polymeric dispersants are interpolymers of oil-solubilizing monomers such as decyl methacrylate, vinyl decyl ether and high molecular weight olefins with monomers containing polar substituents, e.g. aminoalkyl acrylates or acrylamides and poly-(oxyethylene)-substituted acrylates. Examples of polymer dispersants thereof are disclosed in the following U.S. Patents: U.S. Pat. Nos. 3,329,658, 3,449,250, 3,519,656, 3,666,730, 3,687,849, and 3,702,300 which are incorporated herein by reference for disclosure of dispersants.

The above-noted patents are incorporated by reference herein for their disclosures of ashless dispersants.

Borated dispersants are described in U.S. Pat. Nos. 3,087,936 and 3,254,025 which are incorporated herein by reference for disclosure of borated dispersants.

Also included as possible dispersant additives are those disclosed in U.S. Pat. Nos. 5,198,133 and 4,857,214 which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Antioxidants.

Most oleaginous compositions will contain a conventional quantity of one or more antioxidants in order to protect the composition from premature degradation in the presence of air, especially at elevated temperatures. Typical antioxidants include hindered phenolic antioxidants, secondary aromatic amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include ortho-alkylated phenolic compounds such as 2,6-di-tertbutylphenol, 4-methyl-2,6-di-tertbutylphenol, 2,4,6-tri-tertbutylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)-2, 6-di-tertbutyl phenol, 4-ethyl-2,6-di-tertbutylphenol, 2-methyl-6-styrylphenol, 2,6-distyryl-4-nonylphenol, and their analogs and homologs. Mixtures of two or more such mononuclear phenolic compounds are also suitable.

Other phenol antioxidants for use in the compositions of this invention are methylene-bridged alkylphenols, and these can be used singly or in combinations with each other, or in combinations with sterically-hindered unbridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis (4-methyl-6-tert-butylphenol), 4,4'-methylene-bis(2,6-di-tertbutylphenol), and similar compounds. Particularly preferred are mixtures of methylene-bridged alkylphenols such as are described in U.S. Pat. No. 3,211,652, all disclosure of which is incorporated herein by reference.

Amine antioxidants, especially oil-soluble aromatic secondary amines can also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-α-naphthylamine, phenyl-β-napthylamine, alkyl- or aralkylsubstituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, and similar compounds.

A preferred type of aromatic amine antioxidant is an alkylated diphenylamine of the general formula $$R_1—C_6—H_4—NH—C_6H_4—R_2$$

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)(amine) wherein the nonyl groups are branched.

Another useful type of antioxidant for inclusion in the compositions of this invention is comprised of one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tertbutylphenol, and about 2% of 2,4-di-tertbutylphenol. The reaction is exothermic and thus is preferably kept within the range of about 15° C. to about 70° C., most preferably between about 40° C. to about 60° C.

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl) amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii). The antioxidant discussion above is as put forth in U.S. Pat. No. 5,328,619 which is incorporated herein by reference.

Other useful antioxidants are those included in the disclosure of U.S. Pat. No. 4,031,023 which is herein incorporated by reference. The referenced antioxidants of the '023 patent are then included under the formula:

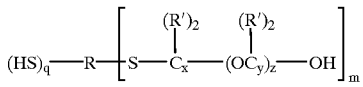

wherein R is a hydrocarbyl or substituted hydrocarbyl containing up to about 30 carbon atoms and having a valence of m+q; each R' is independently selected from hydrogen and a hydrocarbon-based group of up to about 20 carbon atoms; x and y are independently from 2 to 5; z is from zero to 5; q is from zero to 4 and m is from 1 to 5 with the proviso that m+q is from 1 to 6, have increased resistance to oxidative degradation and anti-wear properties. Antioxidants are included in the composition at about 0.1–5 weight percent.

3. Seal Swell Compositions.

Compositions which are designed to keep seals pliable are also well known in the art. A preferred seal swell composition is isodecyl sulfolane. The seal swell agent is incorporated into the composition at about 0.1–3 weight percent. Substituted 3-alkoxysulfolanes are disclosed in U.S. Pat. No. 4,029,587 which is incorporated herein by reference.

4. Friction Modifiers.

Friction modifiers are also well known to those skilled in the art. A useful list of friction modifiers are included in U.S. Pat. No. 4,792,410 which is incorporated herein by reference. U.S. Pat. No. 5,110,488 discloses metal salts of fatty acids and especially zinc salts and is incorporated herein by reference for said disclosures. Said list of friction modifiers includes:

fatty phosphites
fatty acid amides
fatty epoxides
borated fatty epoxides
fatty amines
glycerol esters
borated glycerol esters
alkoxylated fatty amines
borated alkoxylated fatty amines
metal salts of fatty acids
sulfurized olefins
fatty imidazolines
and mixtures thereof.

The preferred friction modifier is a borated fatty epoxide as previously mentioned as being included for its boron content. Friction modifiers are included in the compositions in the amounts of 0.1–10 weight percent and may be a single friction modifier or mixtures of two or more.

Friction modifiers also include metal salts of fatty acids. Preferred cations are zinc, magnesium, calcium, and sodium and any other alkali, or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Antiwear/Extremne Pressure Agents.

Zinc salts are added to lubricating compositions in amounts of 0.1–5 weight percent to provide antiwear protection. The zinc salts are normally added as zinc salts of phosphorodithioic acids. Among the preferred compounds are zinc diisooctyl dithiophosphate and zinc dibenzyl dithiophosphate. Also included in lubricating compositions in the same weight percent range as the zinc salts to give antiwear/extreme pressure performance is dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference.

6. Viscosity Modifiers.

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

Examples of commercially available VMs, DVMs and their chemical types are listed below. The DVMs are designated by a (D) after their number.

| Viscosity Modifiers | Tradename and Commercial Source | |
|---|---|---|
| 1. Polyisobutylenes | Indopol ® | Amoco |
| | Parapol ® | Exxon (Paramins) |
| | Polybutene ® | Chevron |
| | Hyvis ® | British Petroleum |
| 2. Olefin copolymers | Lubrizol ® 7060, 7065, 7067 | Lubrizol |
| | Paratone ® 8900, 8940, 8452 8512 | Exxon (Paramins) |
| | ECA-6911 | Exxon (Paramins) |
| | TLA 347E, 555(D), 6723(D) | Texaco |
| | Trilene ® CP-40, CP-60 | Uniroyal |
| 3. Hydrogenated styrene-diene copolymers | Shellvis ® 50, 40 | Shell |
| | LZ ® 7341, 7351, 7441 | Lubrizol |
| 4. Styrene, maleate copolymers | LZ ® 3702, 3715, 3703 | Lubrizol |
| 5. Polymethacrylates | Acryloid ® 702, 954(D), 985(D), 1019, 1265(D) | Rohm & Haas |
| | TLA 388, 407, 5010(D), 5012(D) | Texaco |
| | Viscoplex ® 4-950(D), 6-500(D), 5151(D) | Rohm GmbH |
| 6. Olefin-graft-polymethacrylate polymers | Viscoplex ® 2-500, 2-600 | Rohm GmbH |
| 7. Hydrogenated poly-isoprene star polymers | Shellvis ® 200, 260 | Shell |

Recent summaries of viscosity modifiers can be found in U.S. Pat. Nos. 5,157,088, 5,256,752 and 5,395,539 which are herein incorporated by reference for disclosure pertinent to this invention. The VMs and/or DVMs are incorporated 5 into the fully-formulated compositions at a level of up to 10% by weight.

7. Pour Point Depressants.

These compositions are particularly useful to improve low temperature qualities of a lubricating oil. A preferred pour point depressant is an alkylnapthlene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are normally used in the range of 0.1–5 weight percent. Examples of tests used to access low temperature low shear-rate rheology of lubricating fluids include ASTM D97 (pour point), ASTM D2983 (Brookfield viscosity), D4684 (Mini-rotary Viscometer) and D5133 (Scanning Brookfield).

Examples of commercially available pour point depressants and their chemical types are:

| Pour Point Depressant | Tradename | Source |
|---|---|---|
| 1. Polymethacrylates | Acryloid ® 154-70, 3004, 3007 | Rohm & Haas |
| | LZ ® 7749B, 7742 7748 | Lubrizol |
| | TC 5301, 10314 | Texaco |
| | Viscoplex ® 1-31, 1-330, 5-557 | Rohm GmbH |
| 2. Vinyl acetate/fumate or maleate copolymers | ECA 11039, 9153 | Exxon (Paramins) |
| 3. Styrene, maleate copolymers | LZ ® 6662 | Lubrizol |

8. Detergents.

Lubricating compositions in many cases also include detergents. Detergents as used herein are metal salts of organic acids. The organic acid portion of the detergent is a sulphonate, carboxylate, phenate, salicylate. The metal portion of the detergent is an alkali or alkaline earth metal. Preferred metals are sodium, calcium, potassium and magnesium. Typically, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should contain on average from about 10 to about 40 carbon atoms, preferably from about 12 to about 36 carbon atoms and preferably from about 14 to about 32 carbon atoms on average. Similarly, the phenates, oxylates and carboxylates have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The most preferred composition is thus an overbased monosulfonated alkylated benzene, and is preferably the monoalkylated benzene. Typically, alkyl benzene fractions are obtained from still bottom sources and are mono- or di-alkylated. It is believed, in the present invention, that the mono-alkylated aromatics are superior to the dialkylated aromatics in overall properties.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

It is preferred that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at about in the ratio of up to about 30:1, preferably 5:1 to 18:1 on an equivalent basis.

The amount of the overbased salt utilized in the composition is typically from about 0.1 to about 10 weight percents on an oil free basis. The overbased salt is usually made up in about 50% oil with a TBN range of 10–600 on an oil free basis. Borated and non-borated overbased detergents are described in U.S. Patents 5,403,501 and 4,792,410 which are herein incorporated by reference for disclosure pertinent hereto.

9. Phosphorus acid.

The lubricating compositions can also include at least one phosphorus acid, phosphorus acid salt, phosphorus acid ester or derivative thereof including sulfur-containing analogs in the amount of 0.002–1.0 weight percent. The phosphorus acids, salts, esters or derivatives thereof include compounds selected from the group consisting of phosphorus acid esters or salts thereof, phosphites, phosphorus-containing amides, phosphorus-containing carboxylic acids or esters, phosphorus-containing ethers and mixtures thereof.

In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. A preferred group of phosphorus compounds are dialkyphosphoric acid mono alkyl primary amine salt as represented by the formula

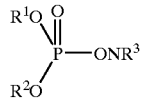

where $R^1$, $R^2$, $R^3$ are alkyl (hydrocarby) groups. Compounds of this type are described in U.S. Pat. No. 5,354,484 which is herein incorporated by reference.

Eighty-five percent phosphoric acid is the preferred compound for addition to the fully-formulated ATF package and is included at a level of about 0.01–0.3 weight percent based on the weight of the ATF.

Sample compositions according to this invention were made up and tested for air entrainment and wear. The tests conducted were ASTM D-3427-93, Standard Test Method for Air Release Properties of Petroleum Oils, and ASTM D 5182-91, Standard Test Method for Evaluating the Scuffing (Scoring) Load Capacities of Oils as modified for testing the compositions of this invention. The ASTM methods are incorporated herein by reference.

The compositions tested were those listed below as Examples 1 and 2, and a Dexron III-ATF reference composition which is available from Southwest Research Institute, San Antonio, Tex. U.S.A. as TX-1863. In the examples, the weight percent for the additives are on an oil-free basis and are based on the weight of the formulated fluid. The red dye is used as purchased without concern for oil content.

EXAMPLE 1

| Weight Percent | |
|---|---|
| Base Oil | 4 cSt PAO or 78% 2 cSt PAO/22% 100 cSt PAO |
| 2.4 | succinimide dispersant |
| 0.2 | borated epoxide |
| 0.5 | sulfur-containing antioxidant |
| 0.65 | di(para-nonyl phenyl) amine |
| 0.1 | dialkyl hydrogen phosphite |
| 0.2 | alkyl naphthalene |
| 0.34 | diluent oil |
| 0.6 | sulfolane seal swell |
| 0.5 | alkylthiodimercaptothiadiazole |
| 40 ppm | silicone/fluorosilicone antifoam agent mix |
| 250 ppm | red dye |

EXAMPLE 2

Same as 1 except 0.5 weight percent dimercaptothiadiazole treated dispersant replaces alkylthiodimercaptothiadiazole.

Gas Bubble Separation Test. D 3427 and Modified D 5182 Scuffing Test results are as follows:

TABLE I

| Sample | 100° C. Kinematic cSt Viscosity | −40° C. Brookfield Viscosity cP | D-3427 (50° C.) | Modified D 5182) |
|---|---|---|---|---|
| Example 1 | 4.63 | 2110 | 207 seconds | passed stage 12 |
| Example 2 | 4.71 | 2210 | 294 seconds | passed stage 12 |
| TX-1863 | 8.05 | 16690 | 590 seconds | passed stage 10 |

Modified ASTM D 5182 is the same as the standard test with the exception that the electric motor speed is increased to 3600 rpm rather than 1450 rpm. The greater speed increases the severity of the test on the oil because of the greater sliding speed under which the oil must perform. Test results demonstrate clearly that the inventive compositions are superior to a standard Dexron® III automatic transmission fluid. This is clear even in face of the low viscosity of Examples 1 and 2 when compared with TX-1863.

When compositions containing the thiadiazoles of the invention were tested according to the standard ASTM D 5182 test, both compositions passed stage 12 of the 12-step procedure.

A further requirement for Dexron® IV transmission fluids is that they meet a minimum kinematic viscosity standard after shear. With the use of certain base oils, viscosity modifiers may be a necessary ingredient of the fully-formulated fluid to meet the standard. The kinematic viscosity standard after shear is a minimum of about 6.5cSt at 100° C. Other values though ranging from 4 cSt upward may find use in some applications. Minimum viscometric values after shear may also be based on a percent 100° C. kinematic viscosity drop after the 20 hour KRL shear test. Values of a viscosity drop of 75% or less are satisfactory. In addition to the use of viscosity modifiers to meet the viscometric standards, higher viscosity base oils either alone or in combination with viscosity modifiers may be used. Examples of compositions which meet the after shear viscometrics minimum value for the 100° C. kinematic viscosity after shear are given below in Table II. The numerical values for additives in Table II are on an oil-free basis and are based on the weight of the formulated fluids. The base oil weight percent values relate only to the base oil. The shear test performed was the 20 hour KRL shear test, DIN 51 350 part 6. The total weight of the fluids equals base oil plus additives and the weight percent of additives are based on this value.

TABLE II

| Example No. | 1 | 2 | 3 | 4 |
|---|---|---|---|---|
| Base Oil (weight %) | | | | |
| 100N | | | 25 | 25 |
| 70N | | 50 | 50 | 50 |
| 6 cSt PAO | 100 | 50 | 25 | 25 |
| Viscosity Modifier | | | | |
| Polymethacrylate | 0.25 | 3.5 | 2.3 | 2.3 |
| Ethylene Propylene | | | 1.5 | 1.5 |
| Dispersant | | | | |
| Succinimide | 2.4 | 2.4 | 2.1 | 2.1 |
| DMTD/Succinimide | 0.5 | 0.5 | 0.25 | 0.25 |
| Borated succinimide | | | | 0.35 |
| Oxidation Inhibitor | | | | |
| Diarylamine | 0.7 | 0.7 | 0.7 | 0.25 |
| Sulfide | 0.5 | 0.5 | 0.5 | |
| Disulfide | | | | 0.75 |
| Friction Modifier | | | | |
| Borated Epoxide | 0.2 | 0.2 | 0.2 | |
| Ethoxylated fatty amine | 0.1 | 0.1 | 0.1 | |
| Dialkyl phosphite | | | | 0.2 |
| Antiwear | | | | |
| Dialkyl hydrogen phosphite | 0.11 | 0.11 | 0.11 | 0.1 |
| Thiocarbamate | | | | 0.5 |
| Seal Swell | | | | |
| Alkyl sulfolane | 1.8 | 1.8 | 0.9 | 0.8 |
| Phosphorus Compound | | | | |
| Amine salt of dialkyl phosphoric ester | | | | 0.4 |
| 85% phosphoric acid | 0.03 | 0.03 | 0.1 | |
| Diluent Oil | 0.34 | 0.34 | 0.34 | |
| Red Dye | 0.025 | 0.025 | 0.025 | |
| Pour Point Depressant | | | | |
| Alkylnapthalene | 0.65 | 0.65 | 0.65 | |
| Foam Inhibitor | | | | |
| Fluorosilicone | 0.004 | 0.004 | 0.004 | 0.004 |
| Polydimethylsiloxane | | | | 0.004 |
| Corrosion Inhibitor | | | | |
| Tolyltriazole | | | 0.02 | |
| DMTD based copper corrosion inhibitor | | | | 0.05 |

What is claimed is:

1. An automatic transmission fluid comprising:

A. A majority of an oil having kinematic viscosity of 2–10 cSt at 100° C.;

B. 0.025–5 weight percent of 2,5-dimercapto-1,3,4-thiadiazole (DMTD) or one or more derivatives of DMTD;

C. an antifoam agent; and

D. 0.01–0.3 weight percent of 85% phosphoric acid; and wherein said final automatic transmission fluid has a Brookfield viscosity value of less than 20,000 cP at −40° C.

2. An automatic transmission fluid, said fluid comprising:

A. A majority of a lubricating oil having kinematic viscosity of 2–10 cSt at 100° C.;

B. 0.025–5 weight percent of 2,5-dimercapto-1,3,4-thiadiazole (DMTD) or one or more derivatives of DMTD;

C. an antifoam agent;

D. 0.01–0.3 weight percent of 85% phosphoric acid; and

E. A viscosity modifier or dispersant viscosity modifier, wherein said viscosity modifier imparts shear stability to said fluid;

and wherein said final automatic transmission fluid has a Brookfield viscosity value of less than about 20,000 cP at −40° C.

3. The fluid according to claims 1 or 2, said fluid ftrther comprising 0.1–10 weight percent of a borated compound selected from the group consisting of: (1) borated epoxides, (2) borated alkoxylated fatty amines, (3) borates fatty esters of glycerol and mixtures thereof.

4. The fluid according to claim 1, said fluid further comprising 0.1–10 weight percent of a viscosity modifier or dispersant viscosity modifier.

5. The fluid according to claims 1 or 2, said fluid further comprising 0.5–10 weight percent of a dispersant selected from the group consisting of (1) carboxylic dispersants, (2) amine dispersants, (3) Mannich dispersants, borated derivative thereof or mixtures thereof.

6. The fluid according to claims 1 or 2, wherein said DMTD derivative is selected from the group consisting of:

a) 2-hydrocarbyldithio-5-mercapto-1,3,4-thiadiazole, or 2,5-bis-(hydrocarbyldithio)-1,3,4-thiadiazole, and mixtures thereof;

b) carboxylic esters of DMTD;

c) condensation products of -halogenated aliphatic monocarboxylic acids with DMTD;

d) reaction products of unsaturated cyclic hydrocarbons and unsaturated ketones with DMTD;

e) reaction products of an aldehyde and diaryl amine with DMTD;

f) amine salts of DMTD;

g) dithiocarbamate derivatives of DMTD;

h) reaction products of an aldehyde and an alcohol or aromatic hydroxy compound and DMTD;

i) reaction products of an aldehyde and a mercaptan and DMTD;

j) reaction product of an oil soluble dispersant with DMTD; and mixtures thereof.

7. The fluid according to claims 1 or 2, wherein said antifoam agent is selected from the group consisting of (1) silicones; (2) fluorosilicones; (3) polyaciylates; (4) siloxane/polyethers or mixtures thereof.

8. The fluid according to claims 1 or 2, wherein said oil is selected from the group consisting of (1) mineral oils; (2) synthetic oils; (3) natural oils including animal and vegetable oils or mixtures thereof.

9. The fluid according to claims 1 or 2, wherein said fluid has a Brookfiel viscosity of less than about 10,000 cP at −40° C.

10. The fluid according to claim 4, wherein said viscosity modifier imparts shear stability to said fluid.

11. The fluid according to claims 1 or 2, wherein said fluid further comprises 0.1–10 weight percent of a friction modifier or mixtures thereof.

12. The fluid according to claims 1 or 2, wherein said fluid further comprises 0.1–5 weight percent of an anfiwear/extreme pressure agent.

13. The fluid according to claims 1 or 2, wherein said fluid further comprises a metal salt of an organic acid.

14. The fluid according to claim 13, wherein said metal salt of an organic acid is a calcium salt selected from the group consisting of salts of (1) carboxylate, (2) phenates, (3) sulfonates, (4) salicylates, and overbased analogs thereof or mixtures thereof.

15. The fluid according to claim 8, wherein said mineral oil is a highly hydrocraked and dewaxed mineral oil.

16. The fluid according to claim 11 wherein the friction modifier comprises a dialkyl phosphite.

17. The fluid according to claim 12 wherein the antiwear/extreme pressure agent comprises dibutyl hydrogen phosphite or diphenyl hydrogen phosphite or a mixture thereof.

18. The fluid according to claim 1 or 2 wherein the antifoam agent (C) comprises a mixture of a silicone antifoam agent and a fluorosilicone antifoam agent.

19. A method of lubricating an automatic transmission, comprising supplying thereto the automatic transmission fluid of claim 1.

* * * * *

UNITED STATES PATENT AND TRADEMARK OFFICE

CERTIFICATE OF CORRECTION

PATENT NO. : 6,251,840 B1
DATED : June 26, 2001
INVENTOR(S) : William C. Ward, Jr., Craig P. Tipton, Kathleen A. Murray It is certified that error appears in the above-identified patent and that said Letters Patent is hereby corrected as shown below:

Claim 3,
Line 16, correct the spelling of "borates" to read -- borated --.

Claim 9,
Line 13, correct the spelling of "Brookfiel" to read -- Brookfield --.

Claim 12,
Line 21, correct the spelling of "anfiwear" to read -- antiwear --.

Claim 15,
Line 31, correct the spelling of "hydrocraked" to read -- hydrocracked --.

Signed and Sealed this

Fifth Day of March, 2002

*Attest:*

*Attesting Officer*

JAMES E. ROGAN
*Director of the United States Patent and Trademark Office*